US006755689B2

(12) United States Patent
Zhang et al.

(10) Patent No.: US 6,755,689 B2
(45) Date of Patent: Jun. 29, 2004

(54) MINIATURE ELECTRICAL CONNECTOR HAVING POWER PAIR ON SIDE SURFACE OF A TONGUE OF A HOUSING THEREOF

(75) Inventors: Yong Zhang, Kunshan (CN); Ziqiang Chu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/295,688

(22) Filed: Nov. 15, 2002

(65) Prior Publication Data

US 2004/0018772 A1 Jan. 29, 2004

(30) Foreign Application Priority Data

Jul. 26, 2002 (TW) ..... 91211441 U

(51) Int. Cl.[7] ..... H01R 13/648
(52) U.S. Cl. ..... 439/607; 439/357
(58) Field of Search ..... 439/607–610, 439/357

(56) References Cited

U.S. PATENT DOCUMENTS

| | | | | |
|---|---|---|---|---|
| 5,362,249 A | | 11/1994 | Carter | 439/357 |
| D390,192 S | | 2/1998 | Ono | D13/147 |
| D391,551 S | | 3/1998 | Ono | D13/147 |
| D410,434 S | | 6/1999 | Wu | D13/147 |
| 6,165,015 A | | 12/2000 | Wu et al. | 439/607 |
| 6,227,904 B1 | * | 5/2001 | Wang et al. | 439/541.5 |
| 6,234,840 B1 | * | 5/2001 | Nakata et al. | 439/607 |
| 6,238,241 B1 | * | 5/2001 | Zhu et al. | 439/541.5 |
| 6,319,062 B1 | * | 11/2001 | Ma et al. | 439/607 |
| 6,364,687 B1 | * | 4/2002 | Chen | 439/358 |
| 6,383,023 B1 | * | 5/2002 | Chang et al. | 439/607 |
| 6,457,983 B1 | * | 10/2002 | Bassler et al. | 439/101 |
| 6,595,801 B1 | * | 7/2003 | Leonard et al. | 439/607 |
| 2002/0048992 A1 | * | 4/2002 | Wang et al. | 439/607 |

OTHER PUBLICATIONS

Max Bassler, "Blazing Ahead with 1394", Connector Specifier, Feb., 1998 pp. 30–31.

* cited by examiner

*Primary Examiner*—Michael C. Zarroli
(74) *Attorney, Agent, or Firm*—Wei Te Chung

(57) ABSTRACT

An electrical connector (1) includes a housing (10), four signal contacts (20), a pair of power contacts (30) and a shielding (40, 50). The housing has a forwardly extending mating tongue (12). The mating tongue defines four receiving channels (126) therein in a vertical direction and a pair of side surface (122). A groove (128) is defined in each of the side surfaces of the mating tongue. Each signal contact comprises a mating portion (21) retained in a corresponding receiving channel. Each power contact comprises a mating portion (31) retained in a corresponding groove of the mating tongue. The shielding substantially surrounds the housing. The connector has a small dimension and can be used in a portable electronic device.

15 Claims, 4 Drawing Sheets

MINIATURE ELECTRICAL CONNECTOR HAVING POWER PAIR ON SIDE SURFACE OF A TONGUE OF A HOUSING THEREOF

BACKGROUND OF THE INVENTION

1. Field of the Invention

The present invention relates to an electrical connector, and more particularly to an IEEE 1394 electrical connector.

2. Description of Related Art

IEEE 1394 standard, originally developed by Institute for Electrical and Electronic Engineers (IEEE) as a replacement for Small Computer Systems Interface (SCSI), is widely used in peripheral devices of the computer or digital products. Related description can be referred to an article of a magazine *CONNECTOR SPECIFIER* published on February 1998, entitled *Blazing Ahead with* 1394, which is submitted herewith by Information Disclosure Statement (IDS). U.S. Pat. Nos. 5,362,249, 6,165,015, D391,551, D390,192 and D410,434 also disclose such IEEE 1394 electrical connectors.

As stated in *Blazing Ahead with* 1394, the IEEE 1394 standard generally contains two connector systems: a six-circuit I/O connector used in peripheral devices and a four-bay unitized connector generally for internal applications. Following the development of digital video device, for example, digital camera or digital camcorder, a four-circuit I/O IEEE 1394 electrical connector is developed for input/out use of the digital video device. The four-circuit IEEE 1394 electrical connector does not have a power pair of the six-circuit IEEE 1394 electrical connector. U.S. Pat. Nos. D391,551 and D390,192,both issued to Naoyuki Ono, disclose such four-circuit IEEE 1394 electrical connectors. Generally, such connectors are small size so that they are suitable for portable application. However, since lacking the power pair, these connectors cannot be used in electronic devices which are not self-powered.

The six-circuit IEEE 1394 electrical connectors, such as those disclosed in U.S. Pat. Nos. 6,165,015, D410,434 and 5,362,249, have the power pair so that they can be used in electronic devices which are not self-powered. However, these connectors are bulky so that they are not suitable for use in portable devices, such as personal digital assistant (PDA), laptop computer or other hand-held digital devices.

Hence, an improved small size IEEE 1394 electrical connector with a power pair is required to overcome above disadvantages of the conventional IEEE 1394 electrical connectors.

SUMMARY OF THE INVENTION

Accordingly, an object of the present invention is to provide a small size electrical connector having power contacts therein so that the connector can be used in a portable electronic device which is not self-powered.

In order to achieve the object set forth, an electrical connector in accordance with the present invention includes a housing, four signal contacts, a pair of power contacts and a shielding. The housing has a forwardly extending mating tongue. The mating tongue defines four receiving channels in a vertical direction and a pair of side surfaces. A groove is defined in each of the side surfaces. Each signal contact comprises a mating portion retained in a corresponding receiving channel. Each power contact comprises a mating portion retained in a corresponding groove of the mating tongue. The shielding substantially surrounds the housing.

The connector has a small dimension and can be used in a portable electronic device.

Other objects, advantages and novel features of the invention will become more apparent from the following detailed description when taken in conjunction with the accompanying drawings.

DETAILED DESCRIPTION OF THE INVENTION

Figure 1:
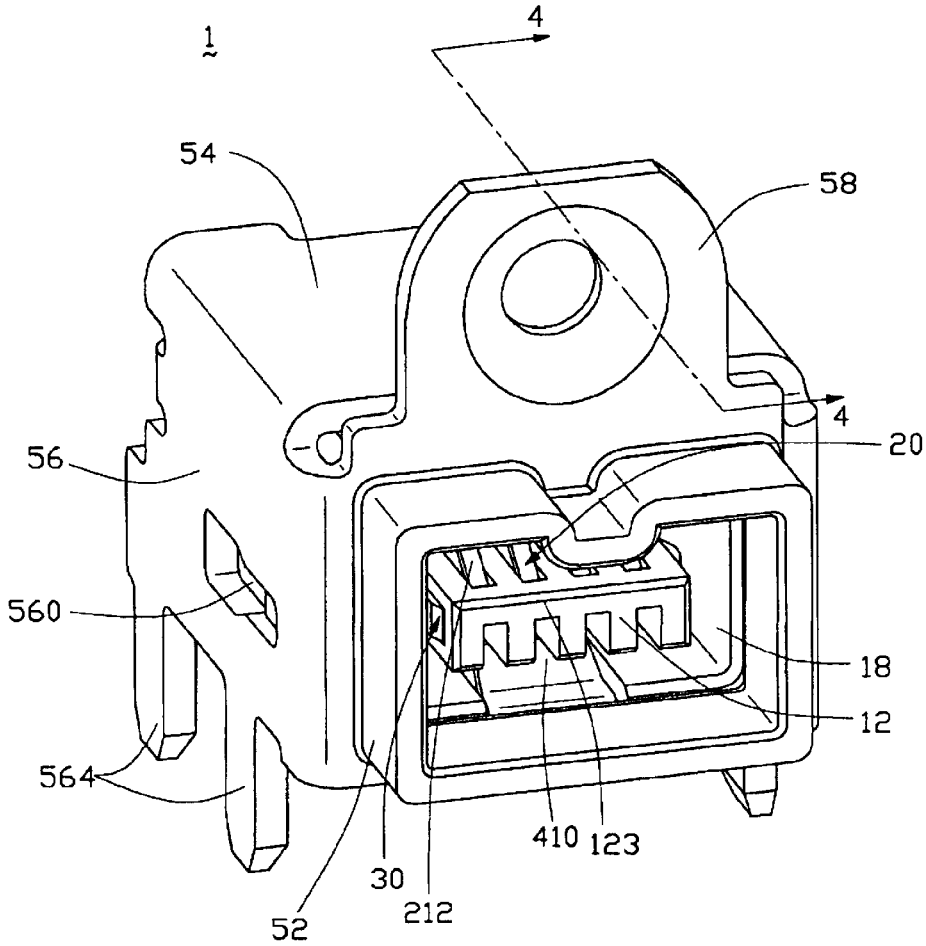
FIG. 1 is a perspective view of an electrical connector in accordance with the present invention.
Figure 2:
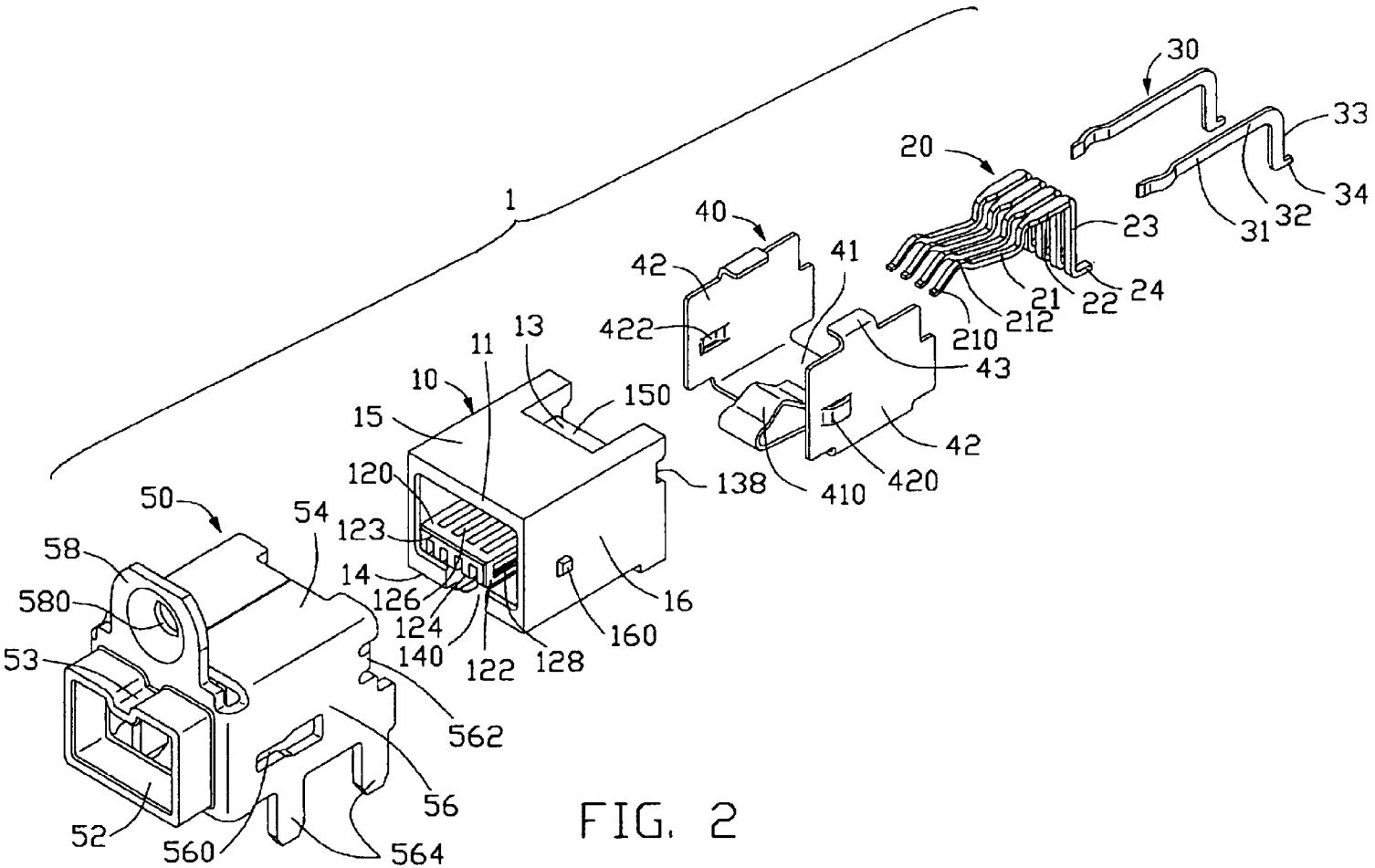
FIG. 2 is an exploded view of the electrical connector of FIG. 1.
Figure 3:
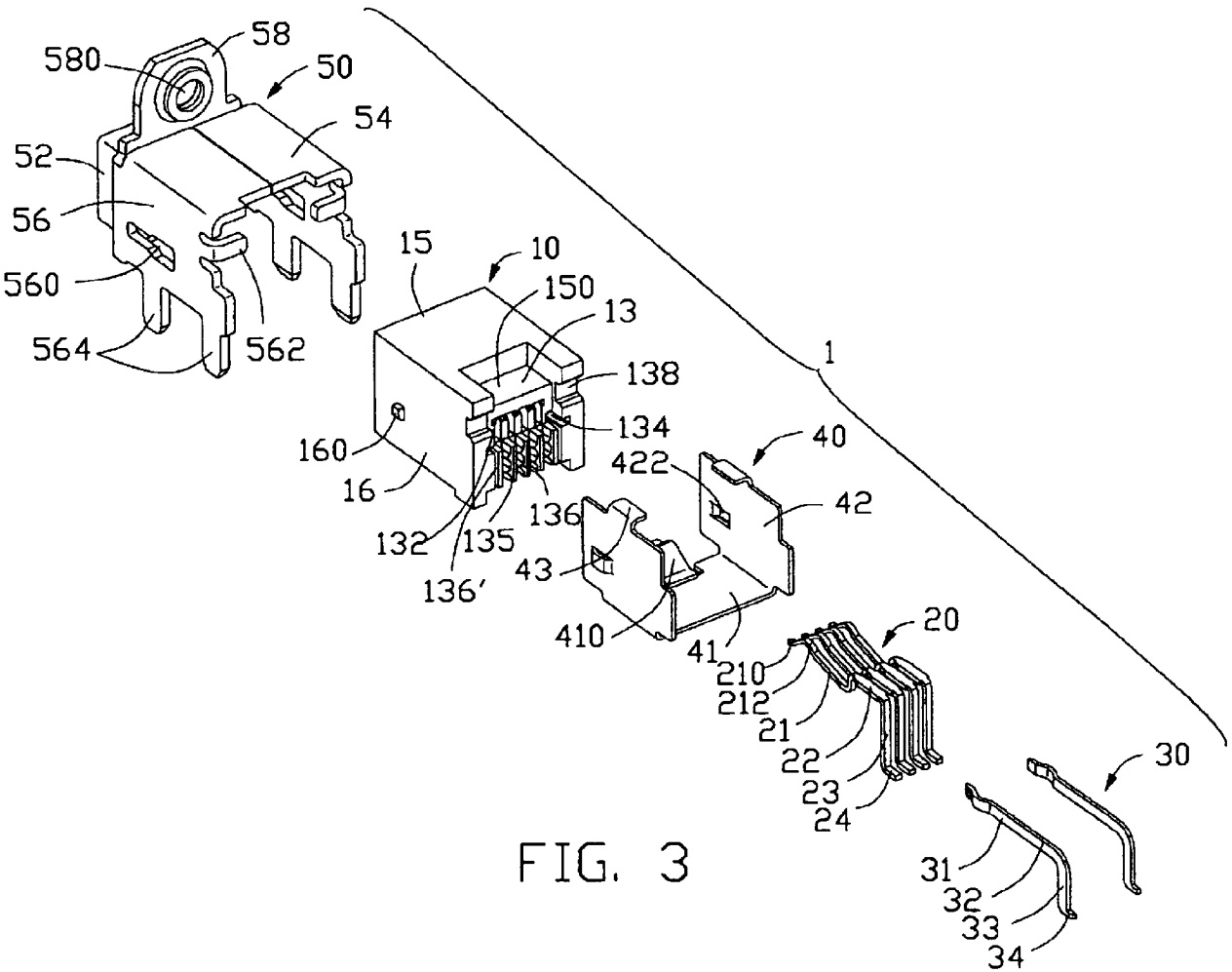
FIG. 3 is a view similar to FIG. 2 but taken from a different aspect.

Referring to FIGS. 1–3, an electrical connector 1, an IEEE 1394 electrical connector having a small form factor, in accordance with the present invention comprises an insulative housing 10, four signal contacts 20, a pair of power contacts 30 (one for transmitting power and one for grounding) and a shielding composed of a first shielding 40 and a second shielding 50. The electrical connector 1 is designed to be mounted on a printed circuit board (not shown) and is adapted for mating with a complementary connector (not shown).

Figure 4:
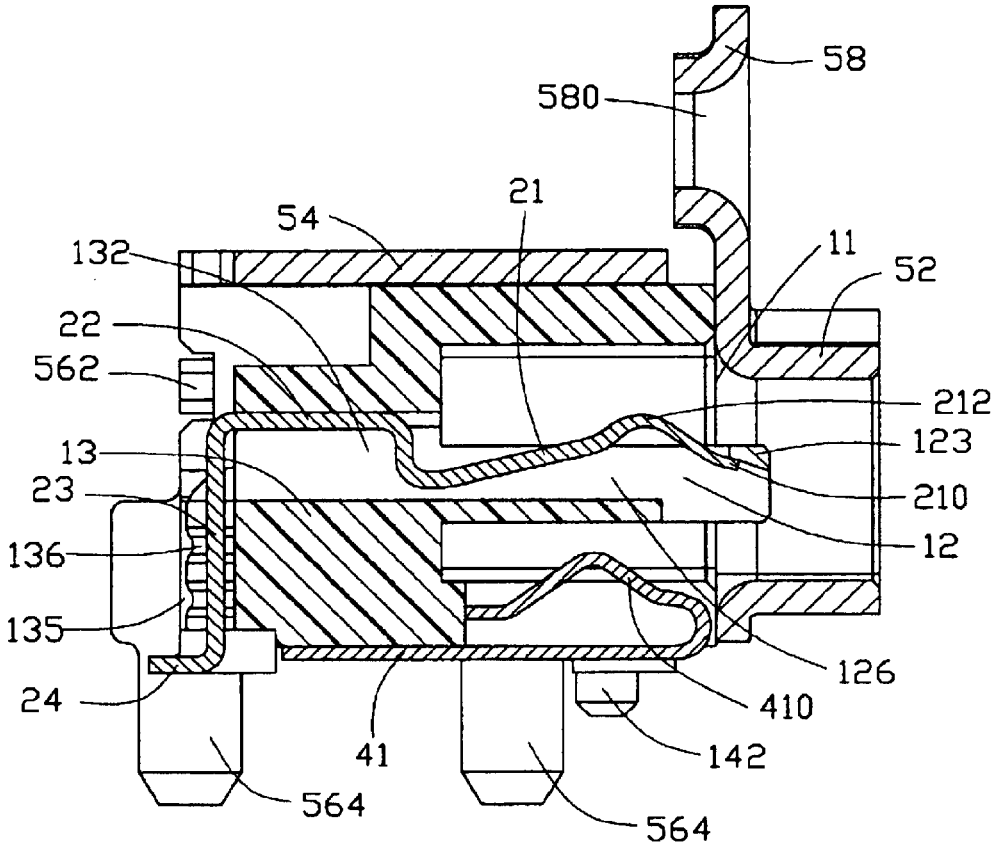
FIG. 4 is a cross-sectional view of the electrical connector taken along line 4—4 of FIG. 1.

The insulative housing 10 is generally rectangular in shape and has a mating face 11 on a front portion thereof, a rear base 13 opposite to the mating face 11 and a mounting face 14 on a bottom portion thereof perpendicular to the mating face 11. The insulative housing 10 comprises an upper wall 15 between a pair of sidewalls 16 thus together forming a receiving space 18 adapted for mating with the complementary connector. The upper wall 15 defines an upper recess 150 adjacent to the rear base 13. Each sidewall 16 defines a projecting rib 160 protruding outwardly therefrom for purposes described hereinafter. The mounting face 14 defines a lower slot 140 in a front end of a middle portion thereof, and a pair of guiding posts 142 (only one shown in FIG. 4) extending downwardly therefrom.

As best shown in FIG. 3, the rear base 13 of the housing 10 defines a plurality of passageways which is composed of four first passageways 132 and a pair of second passageways 134. The pair of second passageways 134 is respectively located adjacent to the sidewalls 16 of the housing 10. A plurality of spacers 135 extends rearward from the rear base 13, whereby four channels 136 are defined between the spacers 135. Each channel 136 corresponds one of the first passageways 132. Two further channels 136' are defined between the sidewalls 16 and two outermost spacers 135. These channels 136 and the two further channels 136' are used for receiving retaining portions 23, 33 of the contacts 20, 30. A pair of rear recesses 138 is defined in rear ends of the sidewalls 16 for retaining corresponding retaining tabs 562 of the second shielding 50 that will be described detail later.

As shown in FIG. 2, a mating tongue 12 integrally extends forwardly from the rear base 13 and beyond the mating face 11. The mating tongue 12 has an upper surface 120, a pair of side surfaces 122 and a lower surface 124 opposite to the upper surface 120. A plurality of receiving channels 126 is defined in the mating tongue 12 in a vertical direction. The receiving channels 126 extend from the upper surface 120 to the lower surface 122. A pair of side grooves 128 is defined in the side surfaces 122, respectively. The mating tongue 12 comprises a plurality of retaining blocks 123 on a front, top corner of the tongue 12. Each receiving channel 126 communicates with a corresponding first passageway 132. Correspondingly, each side groove 128 communicates with a corresponding second passageway 134.

The signal contacts 20, best shown in FIGS. 2–3, each comprise a mating portion 21, a mounting portion 22 extending rearwardly from the mating portion 21, a retaining portion 23 bent downwardly from the mounting portion 22 and a soldering portion 24 for being soldered on the printed circuit board by surface mounting technology. Each mating portion 21 comprises a retaining end 210 located at a front end thereof, and a contact portion 212 curving upwardly for mating with a corresponding signal contact of the complementary connector. Each signal contact 20 is assembled in the housing 10 from the rear base 13. Each mating portion 21 of the signal contacts 20 is retained in a corresponding receiving channel 126 with the retaining end 210 engaging with a corresponding retaining block 123 of the mating tongue 12. Each mounting portion 22 is retained in a corresponding first passageway 132 communicating with the corresponding receiving channel 126 and has an interferential fit with the housing 10. Each retaining portion 23 is received in a corresponding channel 136 of the rear base 13.

Like the signal contacts 20, each of the pair of power contacts 30 comprises a mating portion 31, a mounting portion 32 extending rearwardly from the mating portion 31, a retaining portion 33 bent downwardly from the mounting portion 32, and a soldering portion 34 for being soldered on the printed circuit board by surface mounting technology, as shown in FIGS. 2–3. The pair of power contacts 30 is assembled in the housing 10 from the rear base 13 with each mating portion 31 being retained in a corresponding side groove 128. Each mounting portion 32 is received in a corresponding second passageway 134 communicating with the corresponding side groove 128. Each retaining portion 33 is also retained in a corresponding channel 136' of the rear base 13.

The first shielding 40 and the second shielding 50 are fabricated from metal or other electrically conductive materials. The first shielding 40 comprises a bottom wall 41 and a pair of sidewalls 42 extending upwardly from respective sides of the bottom wall 41. The first shielding 40 is assembled to the housing 10 from the mounting face 14 of the housing 10. The bottom wall 41 of the first shielding 40 defines an engaging tab 410 received in the slot 140 of the mounting face 14 of the housing 10. The engaging tab 410 is devised for electrically engaging with a shielding of the complementary connector when the electrical connector 1 and the complementary connector are mated together. A pair of upper fastening tabs 43 is bent inwardly from top edges of the sidewalls 42. The fastening tabs 43 engage with the upper wall 15 of the insulative housing 10. Each sidewall 42 defines a protrusion 420 projecting outwardly therefrom. A recess 422 is thus formed in the protrusion 420. The recess 422 receives a corresponding projecting rib 160 of the sidewall 16 of the housing 16.

The second shielding 50 is shaped as a rectangular hollow casing. It is used for substantially shielding the subassembly of the housing 10, the contacts 20, 30 and the first shielding 40. The second shielding 50 comprises a mating frame 52 on a front portion thereof, a top wall 54, and a pair of sidewalls 56 extending downwardly from respective sides of the top wall 54. The frame 52 defined a recess 53 in a top face thereof; the recess 53 is used for a polarization purpose. When the subassembly of the housing 10, the contacts 20, 30 and the first shielding 40 is assembled with the second shielding 50, the protrusions 420 of the first shielding 40 are retained in cavities 560 defined in the sidewalls 56 of the second shielding 50. The sidewalls 56 of the second shielding 50 form a pair of retaining tabs 562 each extending inwardly from a rear edge thereof, for being retained in the rear recesses 138 of the housing 10. A retaining portion 58 having a screw hole 580 extends upwardly between the top wall 54 and the mating frame 52. The retaining portion 58 is used for fastening the electrical connector 1 to the complementary electrical connector when mating by a screw. A plurality of retaining feet 564 extends downwardly from a lower side of the sidewalls 56 thereof for being received in corresponding holes of the printed circuit board and soldered thereto.

The advantages of the present invention over the prior art are that each side surface 122 of the mating tongue 12 defines a side groove 128 therein for receiving a power contact 30. The mating tongue 12 thus has a small width; accordingly, the connector 1 has a small dimension and it can be used in a portable electronic device. Furthermore, since the connector 1 has the pair of power contacts 30, electrical power can be transmitted from a host device via the electrical connector 1 in accordance with the present invention to the portable electronic device incorporating the electrical connector 1. Thus, the portable electronic device needs not to be a self-powered device. Accordingly, the present invention can resolve the problems confronted by the prior art connectors.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulating housing, the housing having a forwardly extending mating tongue, the mating tongue having an upper surface, a lower surface and a pair of side surfaces, and defining a plurality of receiving channels in a vertical direction and extending from the upper surface to the lower surface, a groove being defined in each of the side surfaces; and a plurality of contacts composed of a plurality of signal contacts and a pair of power contacts, each contact having a mating portion, the mating portion of each of the signal contacts being retained in a corresponding receiving channel, the mating portion of each of the power contacts being retained in a corresponding groove of the mating tongue.

2. The electrical connector as claimed in claim 1, wherein the housing has a rear base and the mating tongue extends forwardly from the rear base, the rear base of the housing defining a plurality of passageways, and each contact comprises a mounting portion extending rearwardly from the mating portion and retained in a corresponding passageway.

3. The electrical connector as claimed in claim 2, wherein the passageway of the rear base comprises a plurality of first passageways communicating with the corresponding receiving channels and a pair of second passageways communicating with the grooves of the mating tongue.

4. The electrical connector as claimed in claim 1, wherein the mating tongue comprises a plurality of retaining blocks at a front, top corner of the mating tongue, and each signal contact has a retaining end for engaging with a corresponding retaining block.

5. The electrical connector as claimed in claim 2, wherein the rear base defines a plurality of spacers extending rearwardly therefrom, a plurality of channels being defined between the spacers and the spacers and sidewalls of the housing, and each contact comprises a retaining portion bent downwardly from the mounting portion and retained in a corresponding channel defined by the spacers and the spacers and the spacers and the sidewalls of the housing.

6. The electrical connector as claimed in claim 1 further comprising a shielding substantially surrounding the housing.

7. The electrical connector as claimed in claim 6, wherein the shielding comprises a first shielding and a second shielding, and the second shielding surrounds a combination of the first shielding and the housing.

8. An electrical connector comprising:

an insulative housing having a mating face, a pair of sidewalls, an upper wall between the pair of sidewalls thus together forming a receiving space, a rear base opposite to the mating face, and a mating tongue integrally extending forwardly from the rear base and beyond the mating face, the mating tongue defining a plurality of receiving channels in a vertical direction and a groove in each side surface of the mating tongue;

a plurality of contacts composed of a plurality of signal contacts and a pair of power contacts, each contact having a mating portion, the mating portion of each of the signal contacts being retained in a corresponding receiving channel, the mating portion of each of the power contacts being retained in a corresponding groove of the mating tongue; and a first metallic shielding and a second metallic shielding substantially surrounding the housing and the first metallic shielding.

9. The electrical connector as claimed in claim 8, wherein the rear base defines a plurality of first passageways each communicating with a receiving channel of the mating tongue, and each signal contact has a mounting portion retained in the first passageway.

10. The electrical connector as claimed in claim 8, wherein the rear base further defines a pair of second passageways communicating with the grooves of the mating tongue, and each of the pair of power contacts has a mounting portion retained in the second passageway.

11. The electrical connector as claimed in claim 8, wherein the mating tongue comprises a plurality of retaining blocks on a front end thereof, and each signal contact has a retaining end for engaging with the retaining block.

12. An electrical connector comprising:

an insulative housing having a forwardly extending mating tongue with a plurality of signal and power terminals therein;

a one piece lower half metallic shield upwardly assembled to the housing from a bottom face of the housing, said lower half shield defining a U-shaped configuration with a resilient engaging tab extending upwardly from a front edge of a horizontal section of said U-shaped configuration and toward the mating tongue; and a one piece upper half metallic shield rearwardly assembled to the housing from a front face of the housing, wherein said upper half shield includes a mating frame enclosing a front end portion of said mating tongue therein.

13. The electrical connector as claimed in claim 12, wherein said upper metallic half shield further includes an upward retention portion with a screw hole therein.

14. The electrical connector as claimed in claim 12, wherein said upper half metallic shield defines a top wall with joint edges extending in a front-to-back direction thereof.

15. The electrical connector as claimed in claim 12, wherein the mating tongue define opposite upper and lower surfaces, and a plurality of channel extend from the upper surface to the lower surface.

* * * * *